United States Patent [19]

Jewell et al.

[11] 4,142,665

[45] Mar. 6, 1979

[54] ONE PIECE CORRUGATED CONTAINER

[75] Inventors: Steven R. Jewell, Chino; Albert R. Brown, Hughson, both of Calif.

[73] Assignee: The Continental Group, Inc., New York, N.Y.

[21] Appl. No.: 814,982

[22] Filed: Jul. 12, 1977

[51] Int. Cl.[2] ..... B65D 5/28; B65D 5/22; B65D 21/02

[52] U.S. Cl. ..... 229/33; 229/34 R; 229/DIG. 11

[58] Field of Search ..... 229/33, 32, 44, DIG. 11, 229/34 R, 23 R

[56] References Cited

U.S. PATENT DOCUMENTS

| | | | |
|---|---|---|---|
| 1,228,287 | 5/1917 | Boswell et al. | 229/33 |
| 2,488,121 | 11/1949 | Greve | 229/33 |
| 2,511,523 | 6/1950 | Abrams | 229/33 |
| 2,555,718 | 6/1951 | Vineberg | 229/34 X |
| 2,665,050 | 1/1954 | Baumann | 229/33 |
| 2,874,890 | 2/1959 | Evanstein | 229/34 R |
| 3,533,547 | 10/1970 | Houston | 229/34 R |
| 3,547,337 | 12/1970 | Pisarczuk | 229/34 R |
| 3,713,579 | 1/1973 | Chaffers | 229/23 R X |
| 3,820,706 | 6/1974 | Gibson et al. | 229/DIG. 11 X |
| 3,940,053 | 2/1976 | Putman et al. | 229/44 R |
| 4,042,165 | 8/1977 | Elder | 229/33 |

*Primary Examiner*—Davis T. Moorhead
*Attorney, Agent, or Firm*—Charles E. Brown

[57] ABSTRACT

This relates to a container of the tray design which is formed of one piece of corrugated board, the container being particularly adapted for the packing of fruit, tomatoes and other fresh produce items. The container has triple laminated ends and is formed from a substantially rectangular blank with a minimum of waste. The laminated end panels are secured by sets of stripes of adhesive, one set being between each pair of end panels and the stripes of the two sets being in crossing relation. The end panels may be provided with stacking tabs and containing notches.

7 Claims, 6 Drawing Figures

ONE PIECE CORRUGATED CONTAINER

This invention relates in general to new and useful improvements in container construction and more particularly to a one piece container which is formed of corrugated board and is in the form of a tray which is readily stackable. The container is particularly adapted for the packaging of fruit, tomatoes and other fresh produce.

In accordance with this invention, there is provided a one piece, generally rectangular blank which is formed of corrugated board and which blank is divided into panels by means of cut and fold lines. The panels include three separate end panels for each end of the resultant carton with these end panels extending entirely across the opposite ends of the resultant carton.

One of the features of the invention is that the relationship of the end panels at each end of the carton is such that two of the three end panels have the corrugations thereof running vertically so as to provide the desired stack strength.

Another feature of the invention is that the end panels, which are adhesively secured together, are so arranged in the blank that the necessary stripes of adhesive may be applied thereto in a single direction while in the resultant carton, the stripes are arranged at each end of the carton in two sets with the stripes of the two sets extending at right angles to one another.

A further feature of the invention is that the end panels may be selectively formed with stacking tabs which, when provided, will extend up through openings in cover panels and be received in notches formed in the lower part of a next higher like carton.

A further feature of the invention is the provision of a tray like stackable container or carton which is of a one piece construction, which can be formed from a simple substantially rectangular blank with a minimum of loss, and which blank may have the required adhesive placed thereon in a single operation while the blank is moving along a preset path with the resultant carton having the corrugations of the corrugated board from which the blank is formed extending primarily vertically to provide for the necessary stacking strength.

With the above, and other objects in view that will hereinafter appear, the nature of the invention will be more clearly understood by reference to the following detailed description, the appended claims and the several views illustrated in the accompanying drawings.

IN THE DRAWINGS

Figure 1:
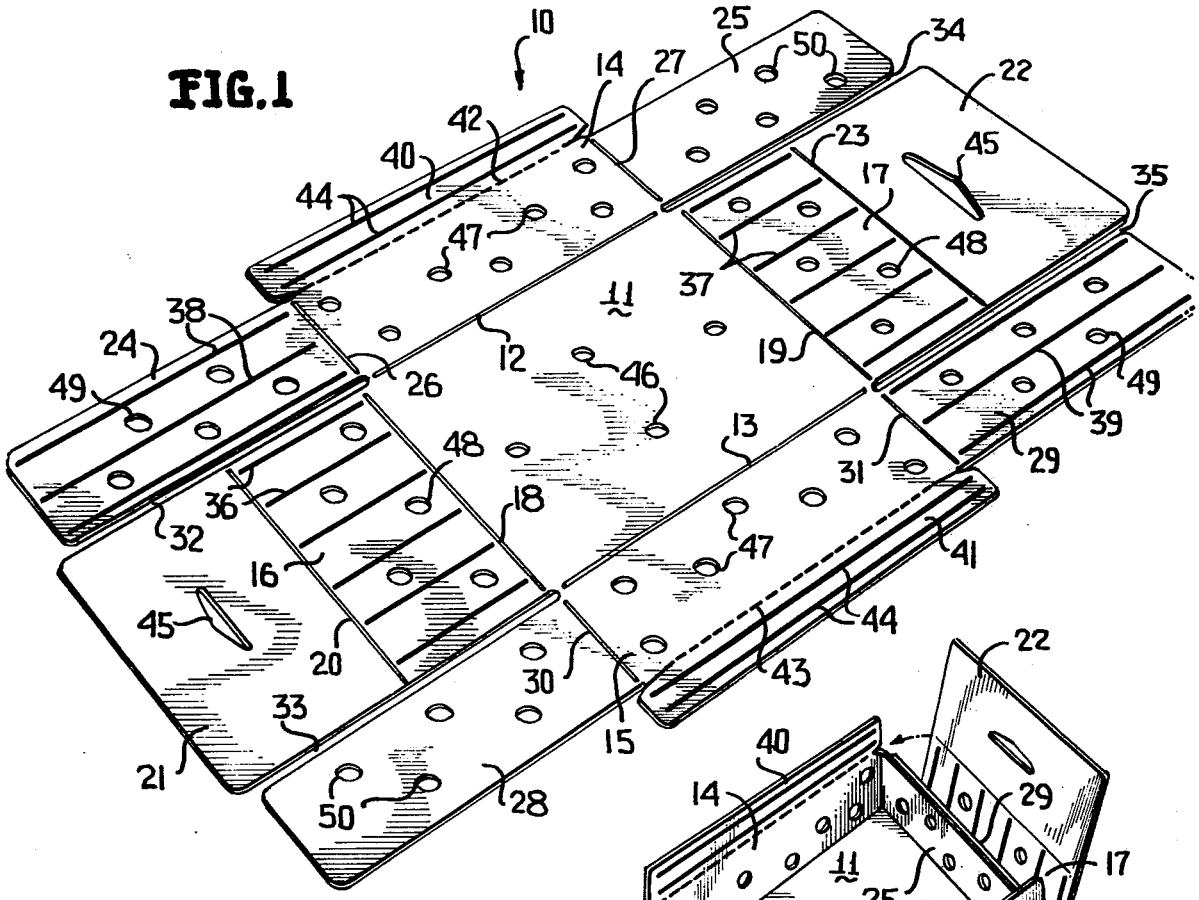
FIG. 1 is a perspective view of a carton blank formed in accordance with this invention.

Referring now to the drawings in detail, it will be seen that there is illustrated in FIG. 1 a carton blank, generally identified by the numeral 10. The carton blank 10 is formed of corrugated board which is preferably wax impregnated.

The blank 10 is elongated and includes a centrally located bottom panel 11 having integrally connected thereto along opposite sides thereof by means of fold lines 12, 13, side panels 14, 15, respectively. It is to be understood that the fold lines 12, 13 extend longitudinally of the blank 10.

End panels 16 and 17 are integrally connected to opposite ends of the bottom panel 11 along transverse fold lines 18, 19, respectively. The end panel 16 has integrally connected thereto along a transverse fold line 20, a closure panel 21. A like closure panel 22 is integrally connected to the end panel 17 along a transverse fold line 23.

The side panel 14 has integrally connected thereto at opposite ends thereof, end panels 24, 25. The end panel 24 is integrally connected to the side panel 14 along a transverse fold line 26, which is offset slightly longitudinally inwardly with respect to the transverse fold line 18, while the end panel 25 is integrally connected to the side panel 14 along a transverse fold line 27 which is also offset longitudinally inwardly slightly further with respect to the transverse fold line 19.

The side panel 15 carries at the opposite ends thereof longitudinally extending end panels 28, 29. The end panel 28 is integrally connected to the side panel 15 along a transverse fold line 30 which is offset longitudinally inwardly with respect to the fold line 26, while the end panel 29 is integrally connected to the side panel 15 along a transverse fold line 31, which is offset longitudinally inwardly and lies longitudinally between the fold lines 19, 27.

At this time it is pointed out that the end panels 24, 28 are generally coextensive with and are disposed on opposite sides of the end panel 16 and the closure panel 21 and are respectively separated therefrom by means of longitudinally extending narrow slots 32, 33 which are generally longitudinally aligned with the fold lines 12, 13, respectively, but disposed transversely outwardly thereof. In a like manner, the end panels 25, 29 are generally coextensive with and disposed on opposite sides of the end panel 17 and the closure panel 22. The end panel 25 is separated from the end panel 17 and the closure panel 22 by a longitudinally extending narrow slot 34 which is generally aligned with the fold line 12, but disposed transversely inwardly thereof. A similar narrow slot 35 separates the end panel 29 from the end panel 17 and the closure panel 22 with the slot 35 being generally aligned with the fold line 13, but disposed transversely inwardly thereof.

It is particularly pointed out here that the slot 32 terminates at the fold line 26 while the slot 33 terminates at the fold line 30. In a like manner, the slot 34 terminates at the fold line 27 and the slot 35 terminates at the fold line 31. The offsetting of the fold lines 26 and 30 with respect to the fold line 38 permits the end panel 28 to be first folded into position followed by the folding of the end panel 24 into position and finally the folding of the end panel 16 into position. The offsetting of the fold lines 27 and 31 with respect to the fold line 19 permits a similar folding of the end panels 25, 29 and 17.

It will also be understood from the foregoing that the side panels 14, 15 are shorter than the bottom panel 11 and that the side panels 14, 15 are not transversely aligned but are slightly offset relative to one another.

At this time it is pointed out that at one end of the resultant carton to be described hereinafter, the end panel 24 is to be secured to the end panel 28 while the end panel 16 is to be secured to the end panel 24. In a like manner, at the opposite end of the resultant carton, the end panel 28 is to be secured to the end panel 23 while the end panel 17 is to be secured to the end panel 29. It is preferred that this securement be by way of an adhesive or glue so that there will be a permanent lamination of the end panels. In order to obtain the necessary adhesive bonding of the respective end panels, the end panels 16 and 17 are provided with adhesive stripes 36, 37, respectively, while the end panels 24, 29 are provided with adhesive stripes 38, 39, respectively.

At this time it is pointed out that the blank 10 also preferably includes a pair of closure panels 40, 41 carried by the side panels 14, 15, respectively. The closure panels 40, 41 are relatively narrow with the closure panel 40 being integrally connected to the side panel 14 along a longitudinally extending fold line 42. The closure panel 41 is integrally connected to the side panel 15 along a longitudinally extending fold line 43.

When it is desired that the closure panels 40, 41 be adhesively secured to the closure panels 21, 22 the closure panels 40, 41 will be provided with adhesive stripes 44. It is to be noted that the adhesive stripes 44 also extend longitudinally of the blank so that they may be applied, together with the previously described adhesive stripes while the blank is moving longitudinally of adhesive applicators in the conventional manner.

At this time it is also pointed out that the closure panels 21, 22 may be provided with suitable handholds 45. The bottom panel 11 may be provided with suitable vent openings 46 and the side panels 14, 15 are provided with suitable vent openings 47. In a like manner, the end panels 17 are provided with vent openings 48 while the end panels 24, 29 are provided with vent openings 49 and the end panels 25, 28 are provided with vent openings 50. It is to be understood that the vent openings 48,49 and 50 are so oriented and spaced whereby when the end panels are disposed in overlapping relation with respect to one another, the vent openings will be in alignment.

Figure 2:
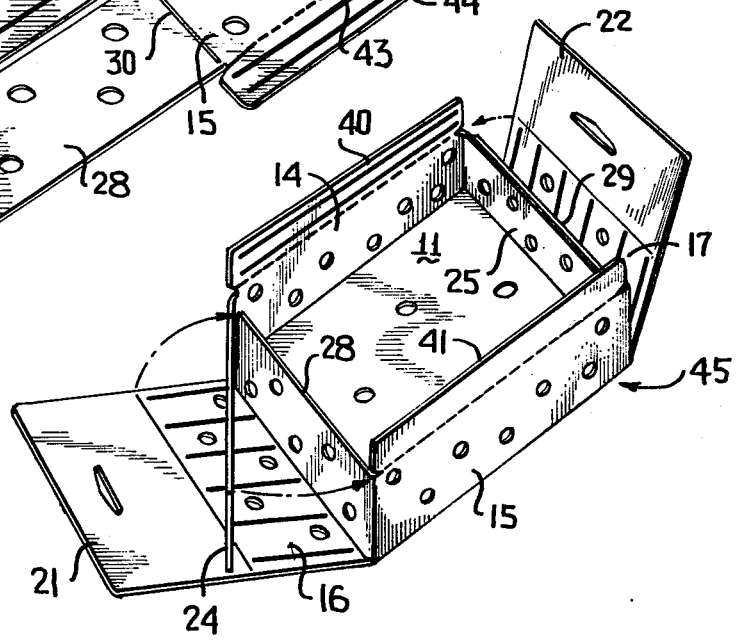
FIG. 2 is a perspective view of the blank of FIG. 1 in a partially erected state.

Referring now to FIG. 2, it will be seen that in the formation of a carton or container from the blank 10, the side panels 14, 15 are first folded to upstanding positions relative to the bottom panel 11, after which the end panels 25, 28 are folded inwardly to extend transversely between the side panels 14, 15 at opposite ends of the bottom panel 11. Then the end panels 24, 29 are folded transversely of the bottom panel 11 outwardly of the end panels 28, 25, respectively. Finally, the end panels 16, 17 are folded upwardly into overlapping relation with respect to the end panels 24, 29, respectively. The adhesive stripes 36, 37, 38 and 39, where necessary, are then activated so as to bond together the end panels 16, 24 and 28 at one end of the bottom panel 11 and the end panels 25, 29 and 17 at the opposite end of the end panels. The carton or container, which is generally identified by the numeral 45, is now complete and ready to be filled.

Figure 3:
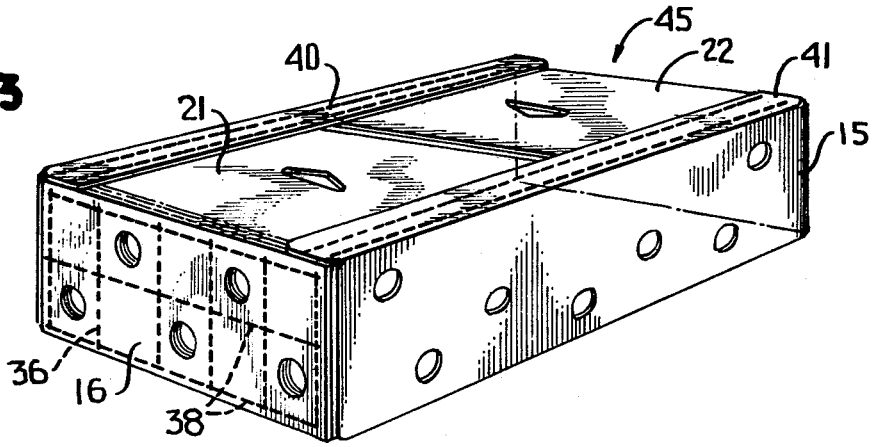
FIG. 3 is a perspective view of a tray like container or carton formed from the blank of FIG. 1.

With reference to FIG. 3, it will be seen that after the tray like carton or container has been filled, the closure panels 21, 22 are folded into place, after which the closure panels 40, 41 are folded into overlying relation thereto and suitably secured thereto, such as by activating the adhesive stripes 44.

Figure 4:
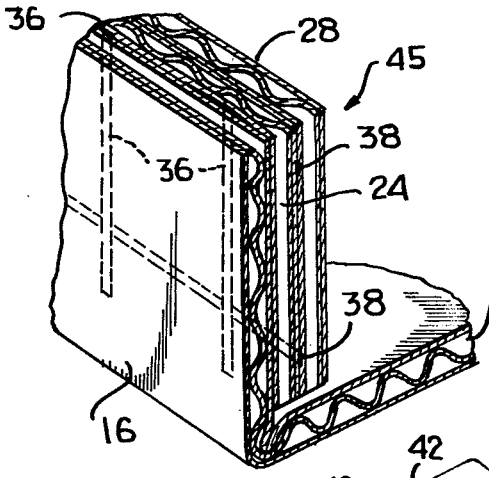
FIG. 4 is a fragmentary vertical sectional view taken through the bottom panel and end of the carton showing the triple lamination of the end and the arrangement of adhesive stripes or lines therein.

It is to be understood that in the carton blank 10, which has already been described as being formed of corrugated board, the corrugations of the board extend transversely. As a result, when the side panels 14, 15 are swung to their vertical positions, the corrugations will run vertically to provide stacking strength at the sides of the carton 45. Although the corrugations in the end panels 16, 17 will run horizontally, it will be seen from FIG. 4 that the corrugations in the end panels 24, 28 will run vertically. The same statement is true of the end panels 17, 25, and 29.

It will be readily apparent from the foregoing that not only is each end of the resultant carton 45 of a triple thickness construction, but also the corrugations of two of those three thicknesses run vertically to provide for a very high stacking strength. In addtion, it will be seen that the adhesive stripes 36 now extend vertically while the adhesive stripes 38 extend horizontally in crossing relation thereto. The same will be true of the adhesive stripes 37 and 39 at the opposite end of the carton. It will also be seen that the closure panels 21, 22 rest on the ends of their respective end panels which, in turn, rest on the bottom panel 11, thus providing for a maximum stacking strength.

Figure 5:
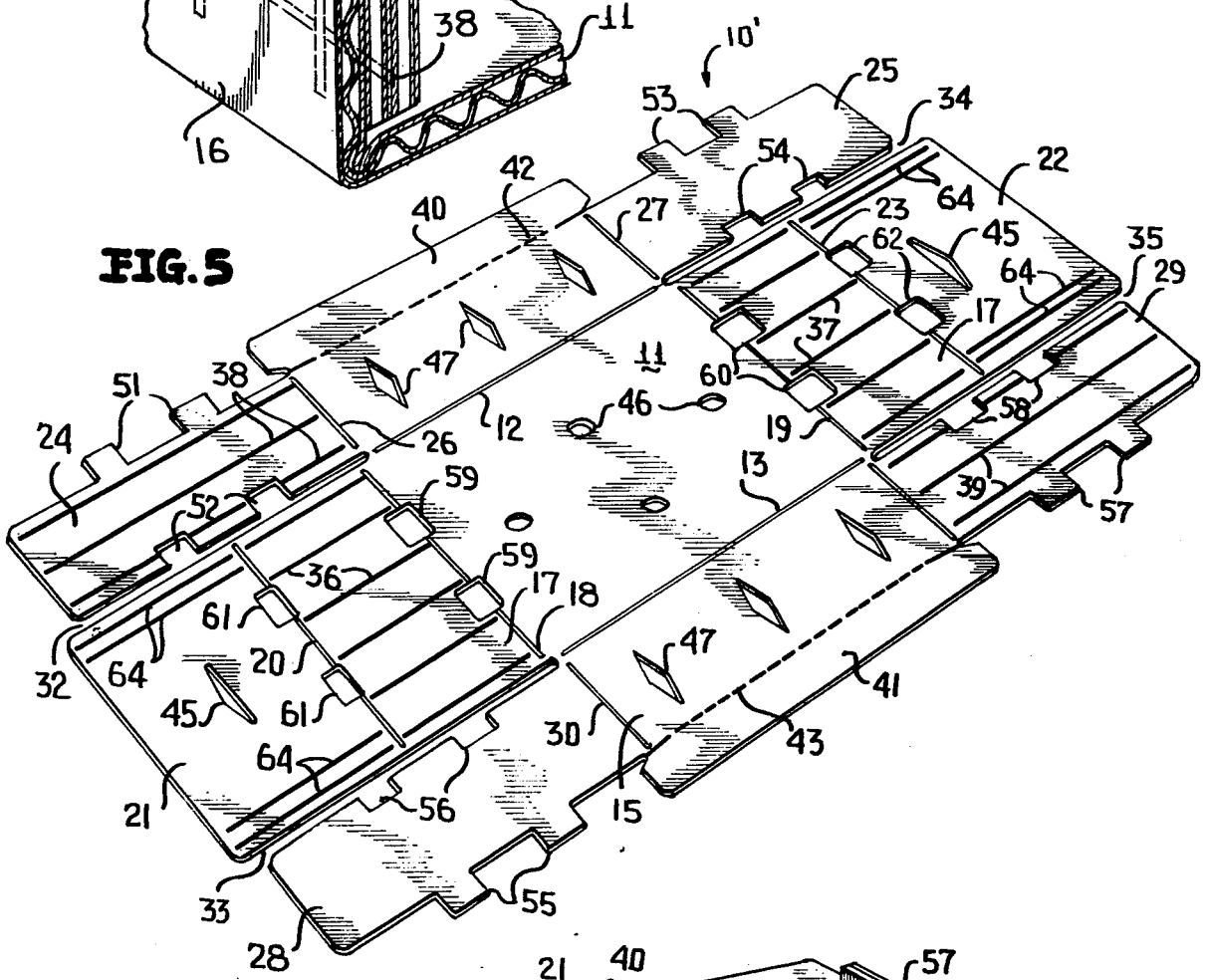
FIG. 5 is a perspective view similar to FIG. 1 showing a modified form of carton blank.

Reference is now made to FIG. 5 wherein a modified form of blank for forming a stacking carton is illustrated. This blank is generally identified by the numeral 10' and will be identical to the blank 10 except as will be pointed out hereinafter. Accordingly, parts of the blank 10' which are identical with parts of of the blank 10 are identified by like reference numerals.

First of all, it is to be noted that the end panel 24 has formed along the longitudinal edge thereof remote from the closure panel 21 and the end panel 14 a pair of stacking tabs 51. In addition, the end panel 24 has formed in the longitudinal edge thereof opposing the closure panel 21 and the end panel 16 and in transverse alignment with the stacking tabs 51 recesses or notches 52 of a size to accommodate stacking tabs such as the stacking tabs 51.

With respect to the end panel 25, it will be seen that it is also provided with stacking tabs identified by the numeral 53. The stacking tabs 53 project from the longitudinal edge of the end panel 25 disposed remote from the closure panel 22 and the end panel 17. The end panel 25 is also provided with notches or recesses 54 in transverse alignment with the stacking tabs 53, the notches 54 being formed in the longitudinal edge of the end panel 25 opposing the end panel 17 and the closure panel 22.

The end panel 28 is provided with a pair of stacking tabs 55. The stacking tabs 55 extend from that longitudinal edge of the end panel 28 remote from the end panel 16 and the closure panel 21. The position of the stacking tabs 55 on the end panel 28 is such that when the end panel 28 is overlapped by the end panel 24, the stacking tabs 51 and 55 will be in alignment with one another.

The longitudinal edge of the end panel 28 opposing the closure panel 21 and the end panel 16 is provided with a pair of notches or recesses 56 which are of a size and position to receive stacking tabs, such as the stacking tabs 55 of a next adjacent panel.

Finally, the end panel 29 is provided along the longitudinal edge thereof remote from the end panel 17 and the closure panel 22 with a pair of stacking tabs 57. The stacking tabs 57 are so positioned along the end panel 29 so that when the end panel 29 overlaps the end panel 25, the stacking tabs 57 will be aligned with the stacking tabs 53.

In order that stacking tabs, such as the stacking tabs 57 of the next lower carton, may be received in the lower part of the end panel 29 in that carton, the longitudinal edge of the end panel 29 opposing the end panel 17, the closure panel 22 is provided with a pair of notches or recesses 58.

The end panel 16 is provided with a pair of notches or cutouts 59 which also extend across the fold line 18 and into the bottom panel 11. The notches or cutouts 59 are positioned for receiving stacking tabs of a next lower carton. Similar notches or cutouts 60 are formed in the end panel 17, the notches 60 extending across the fold line 19 into the bottom panel 11.

Finally, the closure panel 21 has formed therein adjacent the fold line 20 a pair of notches or cutouts 61 which are longitudinally aligned with the notches or cutouts 59. A similar pair of notches or cutouts 62 are formed in the closure panel 22 adjacent the fold line 23.

Figure 6:
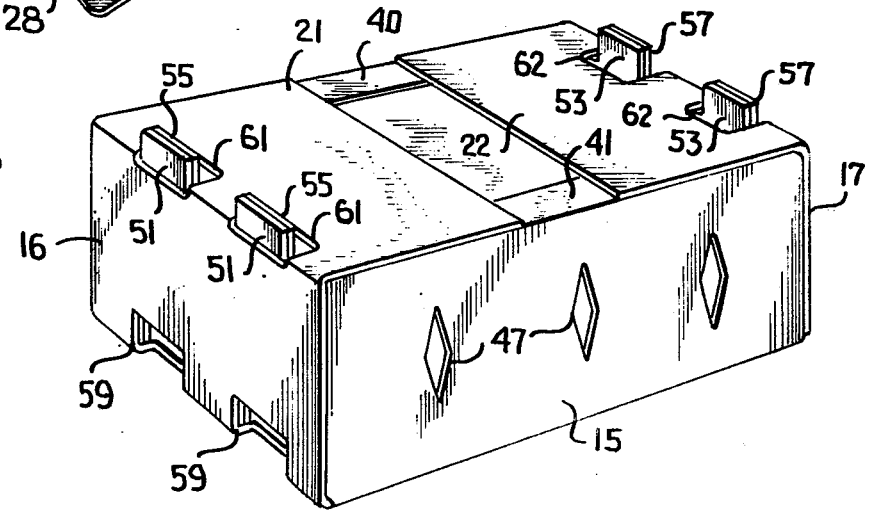
FIG. 6 is a perspective view similar to FIG. 3 showing a modified form of carton formed from the blank of FIG. 5.

Reference in now made to FIG. 6 wherein there is illustrated a carton 65 formed from the blank 10'. It is to be noted that the resultant carton 65 differs slightly from the carton 45 particularly in that the closure panels 21, 22 are illustrated as overlying the closure panels 40, 41. However, it is to be understood that the positions of these closure panels may be reversed in either of the two cartons.

It is also to be noted that in the carbon 65, when the closure panel 21 is folded into place, the aligned stacking tabs 51, 55 extend through the openings defined by the notches or cutouts 61. In a like manner, the aligned stacking tabs 53, 57 extend through the openings defined by the notches or cutouts 62.

It is further pointed out that at the intersection of the end panel 21 with the bottom panel 11 there are formed openings or notches which also extend into the end panels 24, 28 and the bottom panel 11. These openings or notches are defined by the alignment of the notches 52, 56 and 59.

Similar openings or notches are formed at the intersection of the end panel 22 with the bottom panel 11 with these two openings or notches being defined by the aligned notches 54, 58 and 60.

At this time it is pointed out that although in the blank 10 the closure panels 40, 41 are provided with adhesive stripes 44, the blank 10' does not have such adhesive stripes on the closure panels 40, 41. Instead, the closure panels 21, 22 are provided with adhesive stripes 64 along their longitudinal edges.

Although only two preferred embodiments of the invention have been specifically illustrated and described herein, it is to be understood that minor variations may be made in the carton construction without departing from the spirit and scope of the invention as defined by the appended claims.

We claim:

1. A carton blank, said blank being substantially rectangular in outline and comprising a central bottom panel, first end panels at opposite ends of said bottom panel, side panels at opposite sides of said bottom panel, and second and third end panels at opposite ends of respective ones of said side panels, each of said end panels being substantially of the same length, at least two pairs of said end panels having lines of adhesive thereon, said lines of adhesive being parallel to one another and on the same surface of said blank.

2. A carton blank, said blank being substantially rectangular in outline and comprising a central bottom panel, first end panels at opposite ends of said bottom panel, side panels at opposite sides of said bottom panel, second and third end panels at opposite ends of said side panels, each of said end panels being substantially of the same length, and closure panels carried by said first end panels remote from said bottom panel, the combined dimensions of a first end panel and an associated closure panel longitudinally of said blank substantially corresponding to the dimension of said second and third end panels longitudinally of said blank, each first end panel and its associated closure panel being transversely disposed between one of said second end panels and one of said third end panels.

3. A carton blank, said blank being substantially rectangular in outline and comprising a central bottom panel, first end panels at opposite ends of said bottom panel, side panels at opposite sides of said bottom panel, second and third end panels at opposite ends of said side panels, each of said end panels being substantially of the same length, and closure panels carried by said first end panels remote from said bottom panel, the combined dimensions of a first end panel and an associated closure panel longitudinally of said blank substantially corresponding to the dimension of said second and third end panels longitudinally of said blank, the combined longitudinal dimensions of said closure panels being less than the longitudinal dimension of said bottom panel.

4. The carton blank of claim 3 wherein said closure panels carried by said first end panels are partial closure panels, and there are other partial closure panels carried by said side panels remote from said bottom panel, and adhesive means carried by certain of said partial closure panels for securement to others of said partial closure panels for retaining said closure panels in carton closing positions.

5. The carton blank of claim 1 wherein said blank is erected as a rectangular carton, said end panels other than said end panels of said two pairs of end panels being disposed innermost at opposite ends of said carton, said end panels of said two pairs of end panels being disposed in sequence at said opposite ends of said carton, and said lines of adhesive securing together all of said end panels at each end of said carton to form triple ply ends on said carton.

6. The carton blank of claim 2 wherein said blank is erected as a rectangular carton.

7. The carton blank of claim 3 wherein said blank is erected as a rectangular carton.

* * * * *